US007311535B2

(12) United States Patent
Taguchi et al.

(10) Patent No.: US 7,311,535 B2
(45) Date of Patent: Dec. 25, 2007

(54) LEVER FITTING-TYPE CONNECTOR

(75) Inventors: Naoto Taguchi, Shizuoka (JP); Tetsuya Yamashita, Shizuoka (JP); Atsushi Nishida, Aichi (JP); Masato Minakata, Aichi (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/649,884

(22) Filed: Jan. 5, 2007

(65) Prior Publication Data

US 2007/0173091 A1 Jul. 26, 2007

(30) Foreign Application Priority Data

Jan. 11, 2006 (JP) ..... 2006-003474

(51) Int. Cl.
*H01R 13/62* (2006.01)

(52) U.S. Cl. ..... 439/157

(58) Field of Classification Search ..... 439/157
See application file for complete search history.

(56) References Cited

U.S. PATENT DOCUMENTS 6,666,697 B2 * 12/2003 Yamashita ..... 439/157
6,997,725 B2 * 2/2006 Stella et al. ..... 439/157

FOREIGN PATENT DOCUMENTS

JP 2005-122942 5/2005

* cited by examiner

*Primary Examiner*—Tho D. Ta
(74) *Attorney, Agent, or Firm*—Kratz, Quintos & Hanson, LLP

(57) ABSTRACT

A lever fitting-type connector includes a female connector, male connector and lever. The lever includes: a pair of side plates and arranged in parallel to each other, end parts of the side plates and being separated from each other having a distance therebetween; a connecting part for connecting opposite end parts of the side plates and; and fulcrum projections formed at the respective end parts of the side plates and. The lever further includes a flange part formed from an outer edge of the fulcrum projection in an outer peripheral direction. The flange part prevents the fulcrum projections from coming off from a fulcrum projection receiving part.

7 Claims, 8 Drawing Sheets

LEVER FITTING-TYPE CONNECTOR

BACKGROUND OF THE INVENTION (1) Field of the Invention

The present invention relates to a lever fitting-type connector, by which male and female connectors are fit to each other or separated from each other with small force by rotating a lever.

(2) Description of the Related Art

So far, when male and female connectors, each including multi-way terminals, are to be fit to each other, a lever fitting-type connector, by which fitting operation force is reduced by using a lever, has been used (for example, see Japanese Patent Application Laid-Open No. 2005-122942).

Such a lever fitting-type connector is shown in FIGS. 7 and 8. FIG. 7 is a front view of a conventional lever fitting-type connector and FIG. 8 is a perspective view of a lever of the lever fitting-type connector shown in FIG. 7.

The lever fitting-type connector 101 shown in FIG. 7 includes a male connector 103, female connector 102 and lever 104. The male connector 103 includes a male connector body 130 having multi-way terminals and a male connector housing 131 for covering the male connector body 130. The female connector 102 receives the male connector body 130 and includes a female connector housing 120 having terminals that electrically connect with terminals on the side of the male connector 103. As shown in FIG. 8, the lever 104 is formed in a square frame-shape, including side plates 141, 142 arranged in parallel to each other, each having a fulcrum projection 147 at an end part thereof, a first connecting part 144 for connecting the end parts of the side plates 141, 142, and a second connecting part 143 for connecting the opposite end parts of the side plates 141, 142. Further, the lever 104 includes an operation part 145, which is formed in the proximity of the second connecting part 143 and is a portion on which a load of lever rotation is applied, and a through groove 148, each of which is formed on the side plates 141, 142 and penetrates through the side plates 141, 142.

In the lever fitting-type connector 101, an action point projection 132 formed on a surface, which faces the side plate 141, 142 of the male connector housing 131, is inserted into the through groove 148 of the lever 104, so that the lever 104 is rotatably supported by the male connector 103. Further, in the lever fitting-type connector 101, a fulcrum projection 147 of the lever 104 is passed through a through window (not shown in the figure) formed on the male connector housing 131 and caught by a fulcrum projection receiving part 122 formed on the female connector housing 120. That is, in the lever fitting-type connector 101, a contact between the fulcrum projection receiving part 122 and the fulcrum projection 147 forms a fulcrum, a contact between the action point projection 132 and the through groove 148 forms an action point, and the operation part 145 forms a power point.

In the lever fitting-type connector 101, the male connector body 130 and the female connector housing 120 face each other, the fulcrum projection 147 is caught by the fulcrum projection receiving part 122, and the operation part 145 is pressed in a direction in which the operation part 145 approaches the female connector 102, so that the male connector body 130 is received in the female connector housing 120 and the terminals thereof are electrically connected to each other. That is, the male connector 103 fits with the female connector 102.

When the male connector 103 of the lever fitting-type connector 101 is to be assembled, first, the lever 104 is attached to the male connector housing 131 and then, the terminals with electric wires are inserted into terminal receiving chambers of the male connector body 130 integrally formed with the male connector housing or, alternatively, the male connector body 130, in which the terminals with electric wires are inserted in the terminal receiving chambers, is attached to the male connector housing 131 to which the lever 104 is attached. The insertion of the terminals with electric wires and the attachment of the male connector body 130 to the male connector 103 are carried out in a direction going toward the male connector housing 131 from the side of the male connector housing 131, said side being situated away from the female connector 102.

However, in the lever fitting-type connector 101, when the terminals with electric wires or the male connector body 130 is to be attached to the male connector 103, the lever 104 is an obstacle causing deterioration in workability of the assembly. Further, since the lever fitting-type connector 101 is formed in a frame-shape and the electric wires are passed inside the frame, therefore when the lever 104 is broken after the terminals with electric wires or the male connector body 130 is attached to the male connector 103, it is impossible to replace only the lever 104 from the viewpoint of the structure.

For the purpose of solving the above problem, such an idea might be proposed that the lever 104 is formed in a C-shape by removing the first connecting part 144 of the lever 104. In such a case, it is possible to attach the lever 104 to male connector housing 131 after the terminals with electric wires or the male connector body 130 is attached to the male connector 103. However, by removing the first connecting part 144, a moment generated by rotational motion of the lever 104 is applied on the fulcrum projection 147, resulting in that the side plates 141 and 142 are resiliently deformed in a direction leaving each other, causing a new problem that the lever 104 tends to come off from the male connector housing 131.

SUMMARY OF THE INVENTION

It is therefore an objective of the present invention to solve the above problem and to provide a lever fitting-type connector, by which the lever can be attached to the connector after the terminals with electric wires are inserted in the connector and the lever can be prevented from coming off from the connector upon rotational motion of the lever.

In order to attain the above objective, the present invention is to provide a lever fitting-type connector including:

a first connector;

a second connector to be fit with the first connector;

a lever provided rotatably to a connector housing of the second connector, the lever including a pair of side plates arranged in parallel to each other, one end parts of the side plates being separated from each other having a distance therebetween, a connecting part for connecting opposite end parts of the side plates, and a fulcrum projection formed on the one end part of at least one of the side plates and projecting from an inner surface of the side plate toward the opposite side plate;

a fulcrum projection receiving part formed on a surface of the connector housing of the second connector, said surface lying one upon another with the side plate, the fulcrum projection receiving part receiving the fulcrum projection;

a fulcrum projection engaging part formed on a surface of a connector housing of the first connector, said surface lying one upon another with the side plate, the fulcrum projection engaging part engaging with the fulcrum projection received in the fulcrum projection receiving part; and a coming off-preventing means for preventing the fulcrum projection from coming off from the fulcrum projection receiving part, wherein the lever is rotated so that the connector housing of the first connector and the connector housing of the second connector approach or leave each other.

With the construction described above, as for the lever, the end parts of the pair of the side plates are separated from each other having a distance therebetween, therefore the lever can be attached to the second connector after the terminals with electric wires are inserted in the second connector. Therefore, the workability of assembling the second connector can be improved. Since only the lever can be replaced in the event that the lever is broken during use, therefore a man-hour and cost required to replace the lever upon breakage can be reduced. Further, the lever has the coming off-preventing means for preventing the fulcrum projection from coming off from the fulcrum projection receiving part, therefore the lever can be prevented from coming off from the second connector while the lever is rotated.

The coming off-preventing means is a flange part extending in an outer peripheral direction of the fulcrum projection from an outer edge of the fulcrum projection.

With the construction described above, the coming off-preventing means is a flange part extending in an outer peripheral direction of the fulcrum projection from an outer edge of the fulcrum projection. Therefore, even if a moment generated due to the rotation of the lever is applied on the fulcrum projection, the flange is caught by an inner edge of the fulcrum projection receiving part, so that the pair of the side plates is prevented from being resiliently deformed in a direction in which the side plates are parted from each other. Therefore, the lever can be prevented from coming off from the second connector while the lever is rotated.

The fulcrum projection receiving part includes: a large groove part formed larger in size than a summed size of the fulcrum projection and the flange part; and a small groove part formed smaller in size than a summed size of the fulcrum projection and the flange part, wherein the fulcrum projection is positioned in the large groove part on a condition that the connector housing of the first connector and the connector housing of the second connector are parted farthest from each other, wherein the lever fitting-type connector further includes a moving-guiding means for moving the fulcrum projection from the large groove part toward the small groove part in response to rotation of the lever as the connector housing of the first connector and the connector housing of the second connector approach each other.

With the construction described above, since the fulcrum projection receiving part includes the large groove part formed larger in size than a summed size of the fulcrum projection and the flange part, therefore when the lever is attached to the second connector, the fulcrum projection is inserted from the large groove part so that the lever can be easily attached to the second connector. Therefore, the workability of assembly upon attaching the lever to the second connector can be improved. As the connector housings of the first and second connectors approach each other, the fulcrum projection is moved into the small groove part formed smaller in size than a summed size of the fulcrum projection and the flange part by the moving-guiding means in response to the rotation of the lever. Therefore, the lever can be prevented from coming off from the second connector while the lever is rotated.

A pair of the fulcrum projection engaging parts and a pair of the fulcrum projection receiving parts are provided at respective positions linear-symmetrical with respect to an symmetry axis, which is parallel to the approaching-and-leaving direction of the connector housing of the first connector and the connector housing of the second connector, said symmetry axis passing through a center of each surface of the connector housing of the first or the second connector, said surface lying one upon another with the corresponding side plate of the lever.

With the construction described above, the pair of the fulcrum projection engaging parts and the pair of the fulcrum projection receiving parts are provided linear-symmetrically. Therefore, the lever can be attached by selecting a preferable one attaching position of the attaching positions of the two directions. That is, the connecting part of the lever can be arranged avoiding a guiding-out direction of electric wires, so that a degree of freedom for arranging the lever can be improved.

The moving-guiding means includes:

a plurality of action point projections each formed on one of a surface of the connector housing of the second connector and the side plate of the lever, said surface lying one upon another with the side plate of the lever, the action point projection projecting from said one toward another; and a plurality of action point projection receiving parts having a long hole-shape for receiving the action point projections, the action point projection receiving part being formed on said another, wherein a plurality of the action point projections and a plurality of the action point projection receiving parts are arranged along a width direction of the connector housing or along a width direction of the side plate having a corresponding distance therebetween.

With the construction described above, since a plurality of the action point projections and a plurality of the action point projection receiving parts are provided, therefore a rotation locus of the lever can be defined distinctly. Therefore, the operation feeling of the lever can be prevented from being uneven and the operation feeling can be easily adjusted. Therefore, a lever fitting-type connector having excellent workability and operation characteristic can be provided. Further, since the action point projections and the action point projection receiving parts are arranged along the width direction of the connector housing and the side plate having a distance therebetween, therefore a contact between the action point projection and the action point projection receiving part, which contact acts as an action point of the lever, can be dispersively arranged along the width direction and therefore, a moment generated due to the rotation of the lever can be equalized along the width direction of the connector to which the lever is attached. Accordingly, even if the connector, to which the lever is attached, is long in size in the width direction thereof, the connector and the mating connector can be securely fit with each other.

A pair of the action point projections or a pair of the action point projection receiving parts is provided at respective positions linear-symmetrical with respect to an symmetry axis, which is parallel to the approaching-and-leaving direction of the connector housing of the first connector and the connector housing of the second connector, said symmetry axis passing through a center of a surface of the connector housing of the second connector, said surface lying one upon another with the side plate of the lever.

With the construction described above, since the pair of the action point projections or the pair of the action point projection receiving parts is provided linear-symmetrically, therefore the lever can be attached by selecting a preferable one attaching position of the attaching positions of the two directions. That is, a degree of freedom for arranging the lever can be improved.

At least one of the first and second connector is provided with an engaging means engaging with the lever that is positioned at a fitting position where the first and second connectors are fit with each other.

With the construction described above, since at least one of the first and second connector is provided with an engaging means engaging with the lever that is positioned at a fitting position where the first and second connectors are fit with each other, therefore the lever can be maintained to be the fitting position. Therefore, even if unexpected external force is applied on the lever after the engagement of the engaging means, the first and second connectors can be prevented from moving in a direction in which the first and second connectors are parted from each other.

DESCRIPTION OF THE PREFERRED EMBODIMENTS

Figure 1:
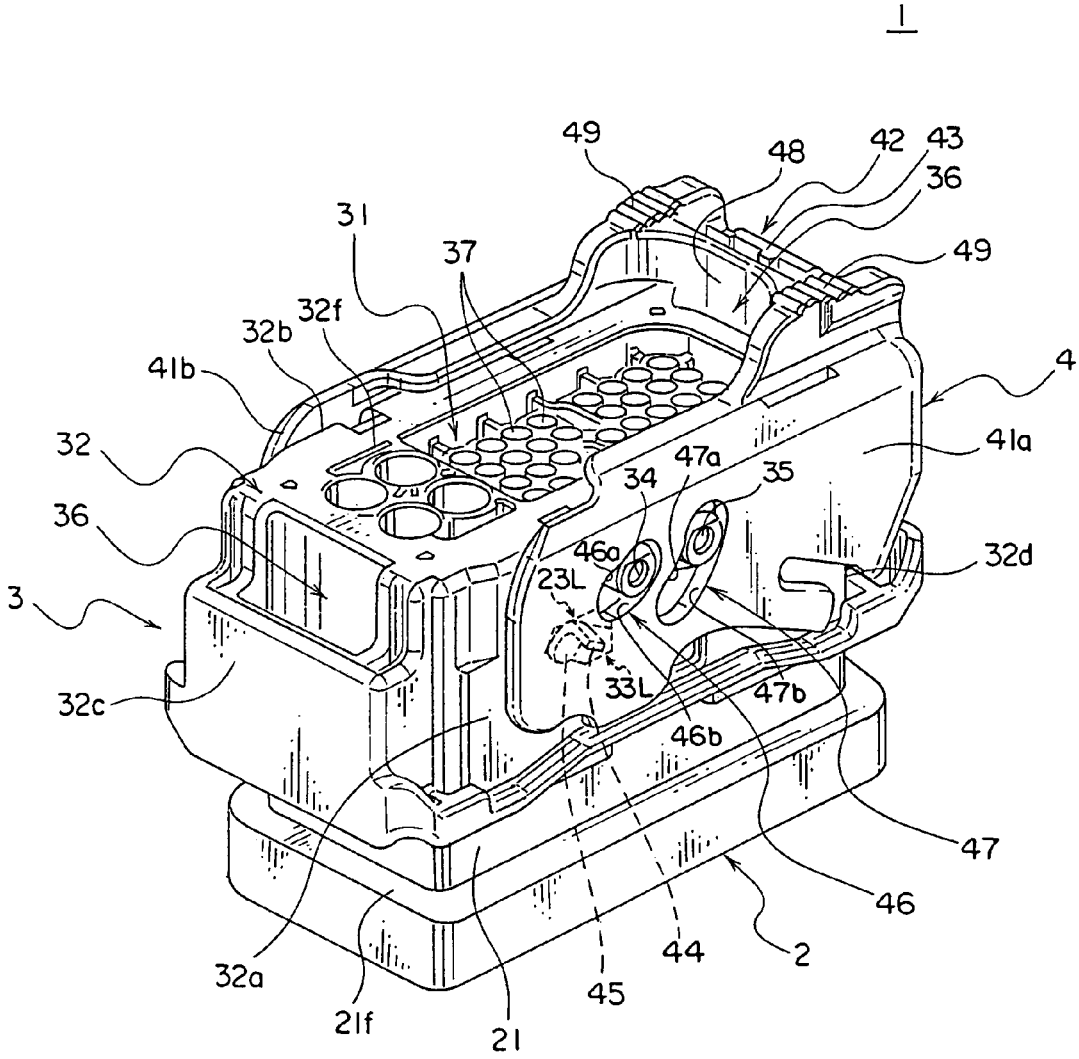
FIG. 1 is a perspective view illustrating a lever fitting-type connector according to a preferred embodiment of the present invention.
Figure 2:
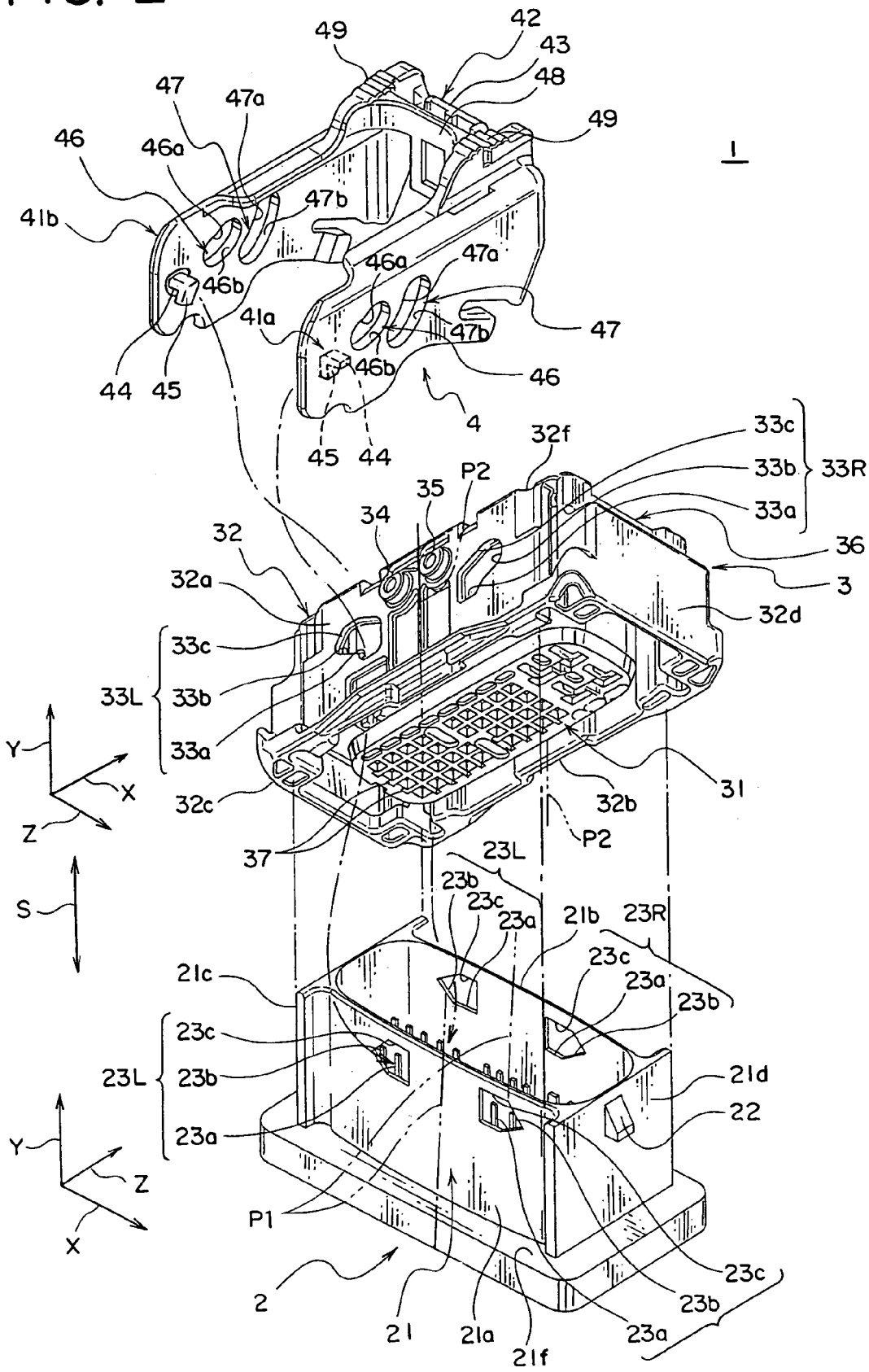
FIG. 2 is an exploded perspective view of the lever fitting-type connector shown in FIG. 1.
Figure 3:
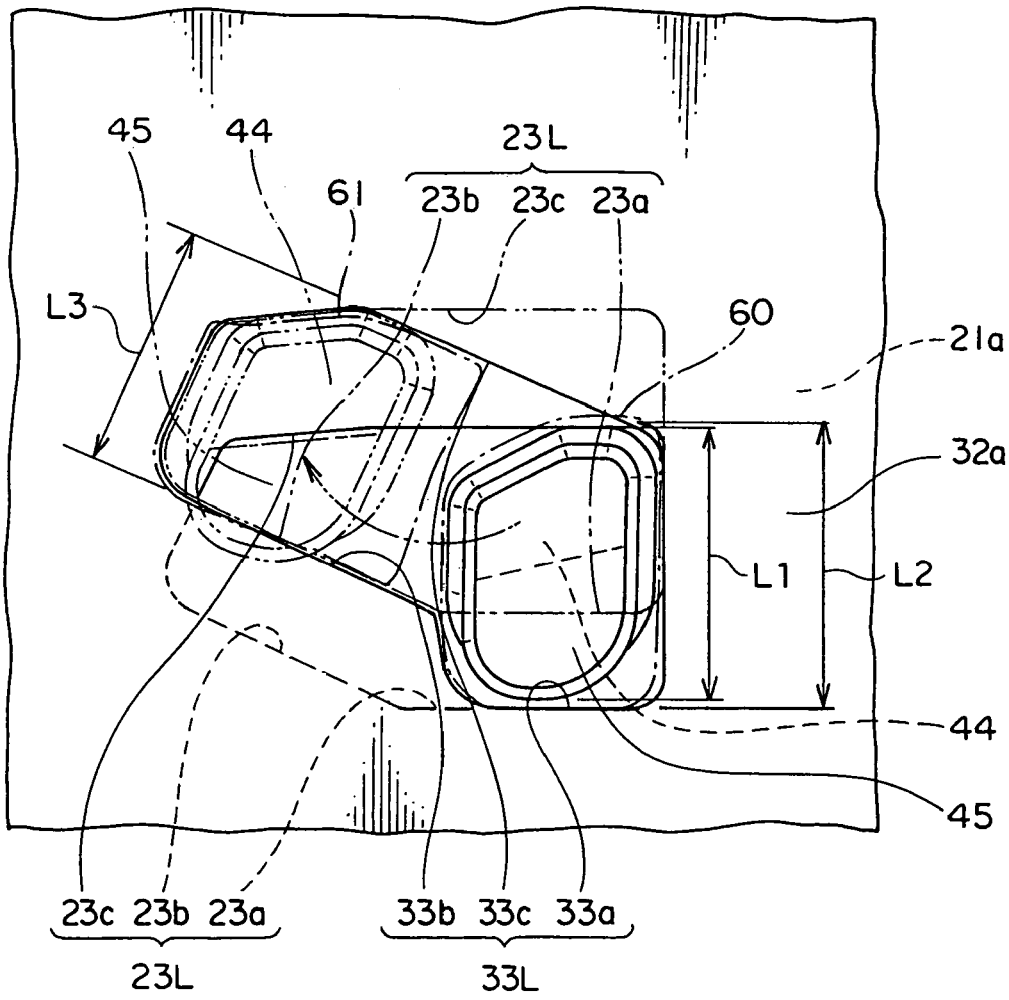
FIG. 3 is a view illustrating a positional relation of the fulcrum projection, fulcrum projection receiving part and fulcrum projection engaging part on a condition that the connector housings of the lever fitting-type connector shown in FIG. 1 are farthest away from each other and a positional relation of the fulcrum projection, fulcrum projection receiving part and fulcrum projection engaging part on a condition that the connector housings fit with each other.
Figure 4:
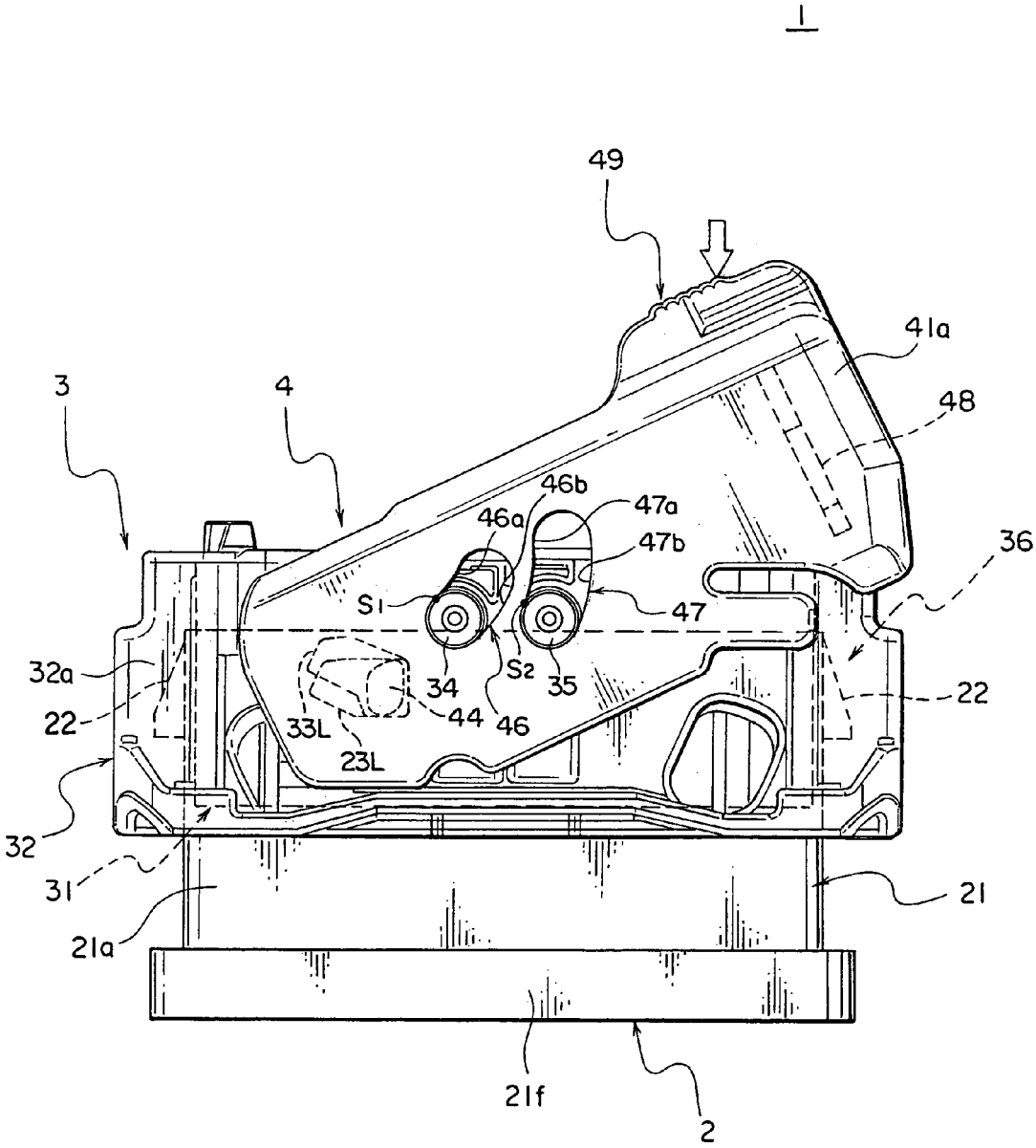
FIG. 4 is a front view illustrating a condition that the lever of the lever fitting-type connector shown in FIG. 1 is engaged with the female connector and that the connector housings are farthest away from each other.
Figure 5:
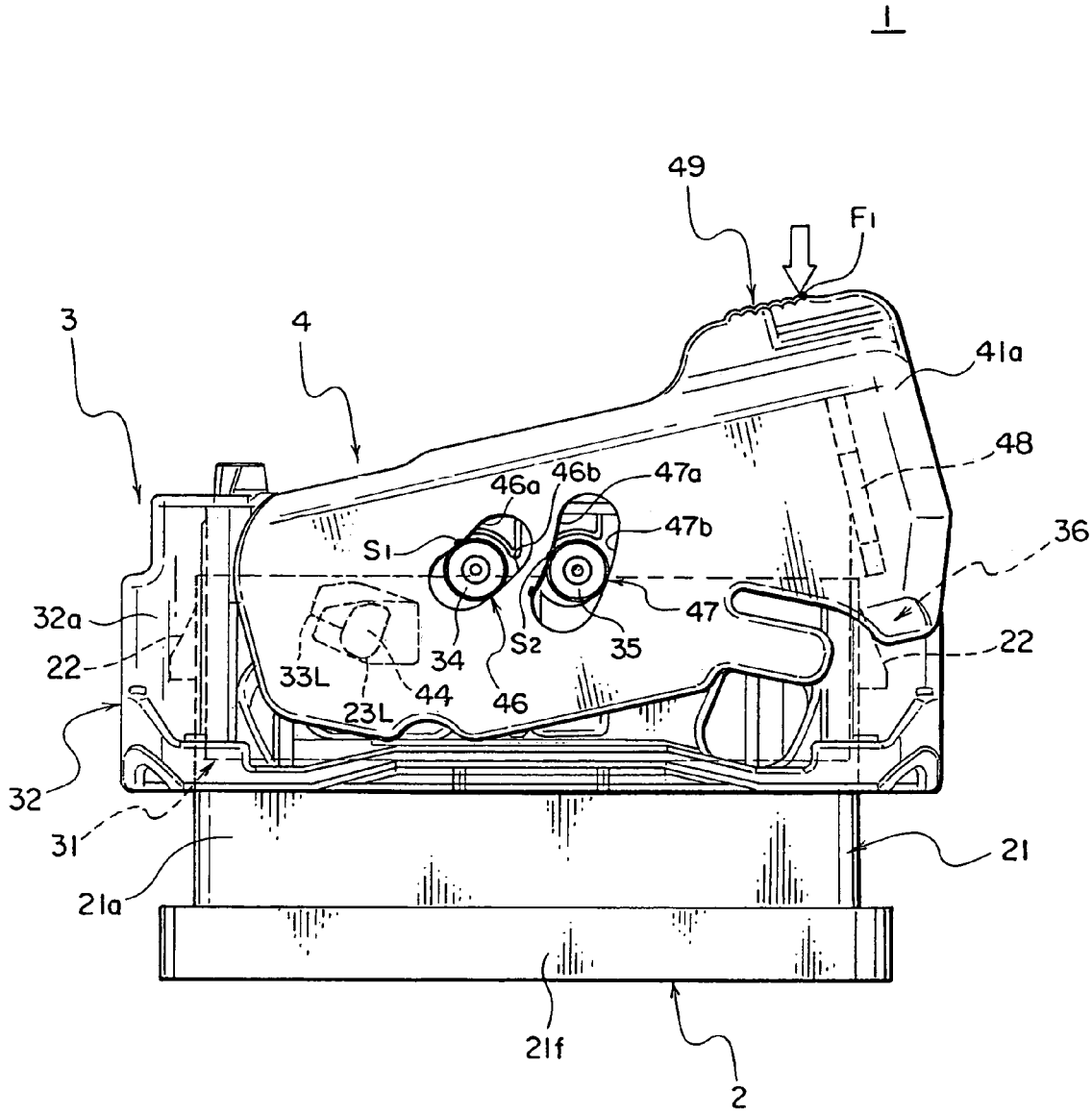
FIG. 5 is a front view illustrating a condition that an outer peripheral surface of the fulcrum projection of the lever fitting-type connector shown in FIG. 4 abuts against the edge of the fulcrum projection engaging part and the rotation force of the lever starts to be transmitted to the male connector.
Figure 6:
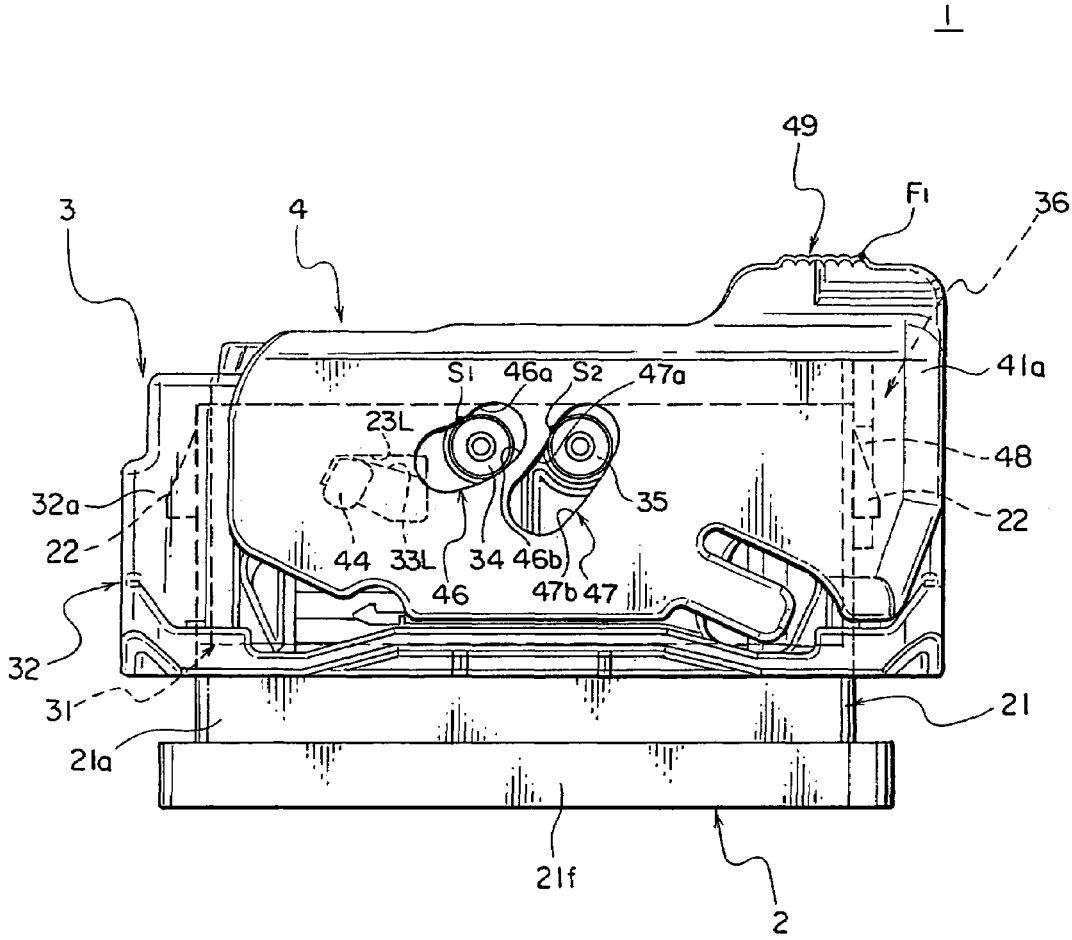
FIG. 6 is a front view illustrating a condition that the connectors of the lever fitting-type connector shown in FIG. 5 fit with each other.
Figure 7:
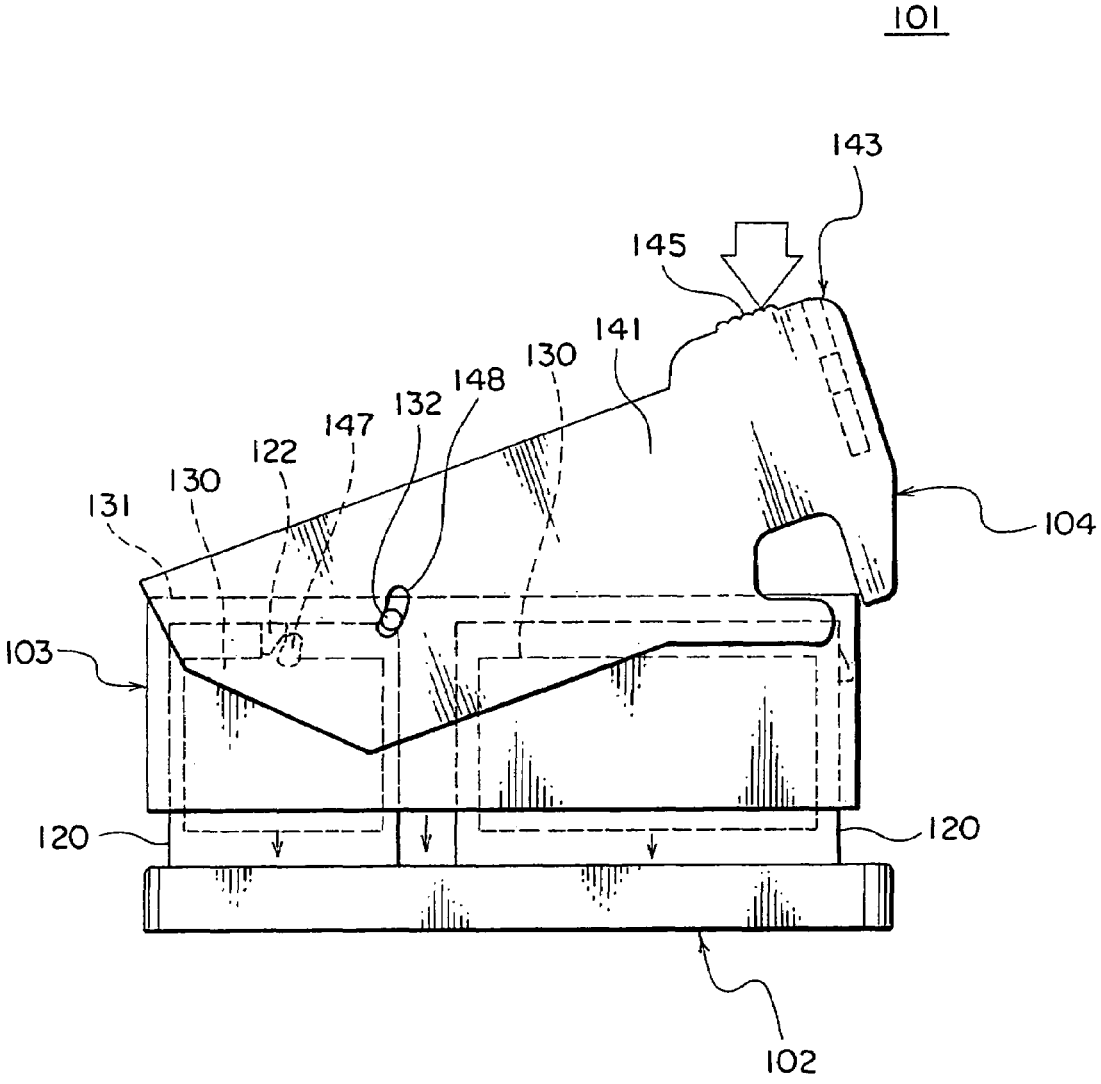
FIG. 7 PRIOR ART
FIG. 7 is a front view illustrating a conventional lever fitting-type connector.
Figure 8:
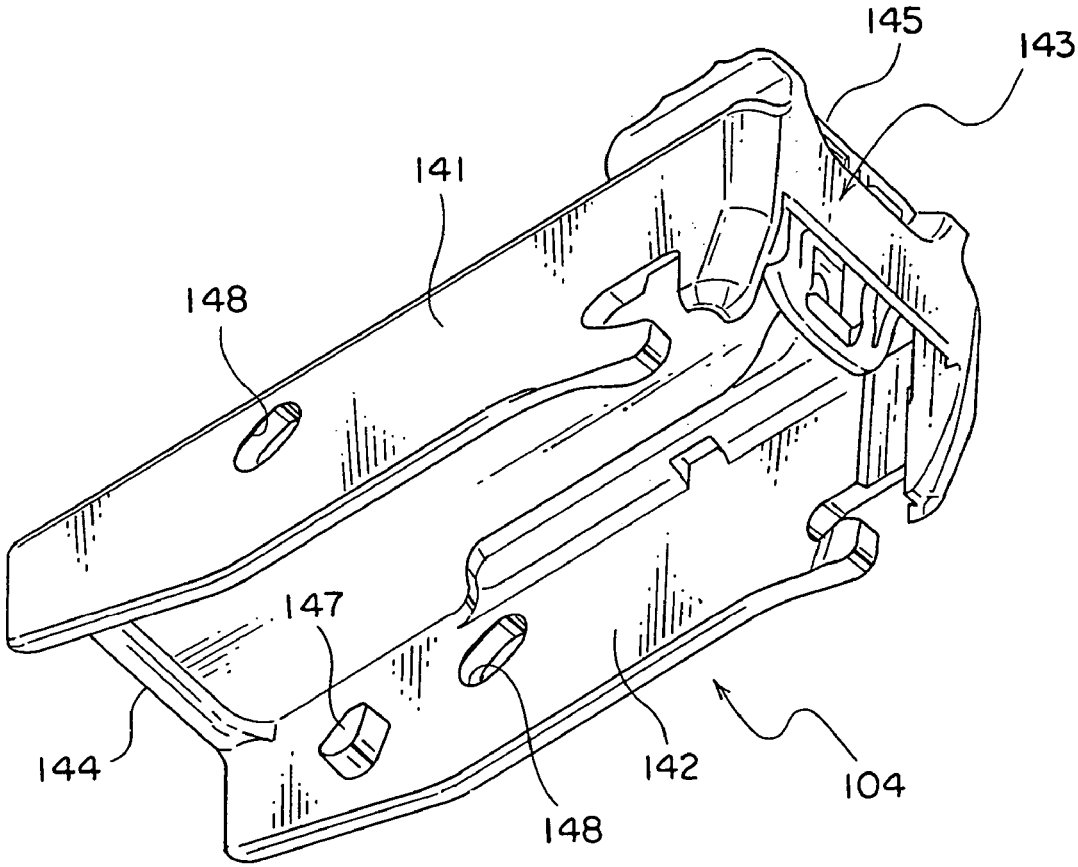
FIG. 8 PRIOR ART
FIG. 8 is a perspective view illustrating the lever of the conventional lever fitting-type connector shown in FIG. 7.

In the following, a lever fitting-type connector 1 according to a preferred embodiment of the present invention is explained with reference to FIGS. 1-6. FIG. 1 is a perspective view illustrating a lever fitting-type connector according to a preferred embodiment of the present invention. FIG. 2 is an exploded perspective view of the lever fitting-type connector shown in FIG. 1. FIG. 3 is a view illustrating a positional relation of the fulcrum projection, fulcrum projection receiving part and fulcrum projection engaging part on a condition that the connector housings of the lever fitting-type connector shown in FIG. 1 are farthest away from each other and a positional relation of the fulcrum projection, fulcrum projection receiving part and fulcrum projection engaging part on a condition that the connector housings fit with each other. FIG. 4 is a front view illustrating a condition that the lever of the lever fitting-type connector shown in FIG. 1 is engaged with the female connector and that the connector housings are farthest away from each other. FIG. 5 is a front view illustrating a condition that an outer peripheral surface of the fulcrum projection of the lever fitting-type connector shown in FIG. 4 abuts against the edge of the fulcrum projection engaging part and the rotation force of the lever starts to be transmitted to the male connector. FIG. 6 is a front view illustrating a condition that the connectors of the lever fitting-type connector shown in FIG. 5 fit with each other.

The lever fitting-type connector 1 according to the preferred embodiment shown in FIG. 1 has a waterproofing function and includes: a female connector 2 as the first connector; a male connector 3 as the second connector, which fits with the female connector 2; and a lever 4, which is formed rotatably on the male connector 3 and causes the connectors 2 and 3 to approach or leave each other along the longitudinal direction of a male terminal and female terminal (explained later on) between a fitting condition of the connectors 2 and 3 and a non-fitting condition thereof. The approaching-and-leaving direction of the connector housings of the connectors 2 and 3 is shown by an arrow S in FIG. 2. The approaching-and-leaving direction S is parallel to the longitudinal direction of a male terminal and female terminal (explained later on).

As shown in FIG. 2, the female connector 2 includes: a female connector housing 21, which is made of electrically insulating synthetic resin and formed in a box-shape; and a plurality of terminals arranged inside the female connector housing 21. Each terminal is a male terminal formed in a bar-shape and connected to an electric wire (not shown in the figure) at the side of the terminal, said side being situated away from the male connector 3.

The female connector housing 21 includes a bottom face 21*f* situated away from the male connector 3 and four faces 21*a*, 21*b*, 21*c* and 21*d* each standing up from the bottom face 21*f*. The faces 21*a* and 21*b* are formed parallel to each other having a distance therebetween. Also, the faces 21*c* and 21*d* are formed parallel to each other having a distance therebetween. Each width of the faces 21*a* and 21*b* in a width direction X (i.e. a distance from an end thereof near to the face 21*c* to an end thereof near to the face 21*d*) is longer than each width of the faces 21*c* and 21*d* in a thickness direction Z (i.e. a distance from an end thereof near to the face 21*a* to an end thereof near to the face 21*b*). The width direction X and the thickness direction Z cross at right angles a depth direction Y (shown in FIG. 2) of the faces 21*a*, 21*b*, 21*c* and 21*d*. The width direction X and the thickness direction Z cross at right angles each other. The depth direction Y is parallel to the longitudinal direction of the male terminal and also to the approaching-and-leaving direction S. The side of the female connector housing 21 facing the bottom face 21*f* is opened, that is, forms an opening. A male connector body 31 (explained later on) of the male connector 3 is inserted toward the bottom face 21*f* from the side of the opening.

Each of the faces 21*a* and 21*b* is the surface lying one upon another with the side plate and includes fulcrum projection engaging parts 23L and 23R, with which fulcrum projections 44 (explained later on) engage. The fulcrum projection engaging parts 23L and 23R are provided linear-symmetrically with respect to respective symmetry axes P1 (shown in FIG. 2) of the faces 21*a* and 21*b* in terms of their shapes and positions. The symmetry axes P1 passes through respective centers of the faces 21*a* and 21*b* and are parallel to the approaching-and-leaving direction S. The fulcrum projection engaging parts 23L and 23R are formed penetrating through the faces 21*a* and 21*b*. A shape of the fulcrum projection engaging parts 23L and 23R is explained later on.

Each of the faces 21*c* and 21*d* includes a locking projection 22 as an engaging means, which projects from an outer surface of the face 21*c*, 21*d* toward the outside of the female connector housing 21. The locking projection 22 engages with a locking arm 48 (explained later on).

As shown in FIG. 2, the male connector 3 includes: a male connector housing 32, which is made of electrically insulating synthetic resin and formed in a box-shape; and a male connector body 31 arranged inside the male connector housing 32 and formed in a rectangular shape. The male connector body 31 includes: a body part, which is made of electrically insulating synthetic resin and has a plurality of terminal receiving chambers 37; and a plurality of terminals inserted in the respective terminal receiving chambers 37. Each terminal is a female terminal formed in a tube-shape and connected to an electric wire (not shown in the figure) at the side of the terminal, said side being situated away from the female connector 2.

The male connector housing 32 includes a top face 32*f* situated away from the female connector 2 and four faces 32*a*, 32*b*, 32*c* and 32*d* each standing up from the top face 32*f*. The faces 32*a* and 32*b* are formed parallel to each other having a distance therebetween. Also, the faces 32*c* and 32*d* are formed parallel to each other having a distance therebetween. Each width of the faces 32*a* and 32*b* in a width direction X (i.e. a distance from an end thereof near to the face 32*c* to an end thereof near to the face 32*d*) is longer than each width of the faces 32*c* and 32*d* in a thickness direction Z (i.e. a distance from an end thereof near to the face 32*a* to an end thereof near to the face 32*b*). The width direction X and the thickness direction Z cross at right angles a depth direction Y (shown in FIG. 2) of the faces 32*a*, 32*b*, 32*c* and 32*d*. The width direction X and the thickness direction Z cross at right angles each other. The depth direction Y is parallel to the longitudinal direction of the female terminal and also to the approaching-and-leaving direction S. The side of the male connector housing 32 facing the top face 32*f* is opened.

Each of the faces 32*a* and 32*b* is the surface lying one upon another with the side plate and includes fulcrum projection receiving parts 33L and 33R for receiving fulcrum projections 44 (explained later on). The fulcrum projection receiving parts 33L and 33R are provided linear-symmetrically with respect to respective symmetry axes P2 (shown in FIG. 2) of the faces 32*a* and 32*b* in terms of their shapes and positions. The symmetry axes P2 passes through respective centers of the faces 32*a* and 32*b* and are parallel to the approaching-and-leaving direction S. The fulcrum projection receiving parts 33L and 33R are formed penetrating through the faces 32*a* and 32*b*. A shape of the fulcrum projection receiving parts 33L and 33R is explained later on.

Each of the faces 32*a* and 32*b* includes action point projections 34 and 35 to be received by action point projection receiving parts 46 and 47 (explained later on), respectively. The action point projections 34 and 35 are arranged along the width direction X having a distance therebetween. Also, the action point projections 34 and 35 are arranged linear-symmetrically with respect to the symmetry axis P2 in the width direction X in terms of a shape and position thereof. Each of the action point projections 34 and 35 is formed a round cylindrical shape in its plan view and projects toward the outside of the male connector housing 32 from an outer surface of the face 32*a*, 32*b*.

The male connector body 31 is arranged having a distance with respect to the male connector housing 32, that is, with respect to the faces 32*a*, 32*b*, 32*c* and 32*d*. The faces 21*a*, 21*b*, 21*c* and 21*d* of the female connector housing 21 are inserted into between the male connector body 31 and the male connector housing 32 along the approaching-and-leaving direction S. Further, the male connector body 31 is inserted into the female connector housing 21. At that time, as for a positional relation between the faces 21*a*, 21*b*, 21*c* and 21*d* of the female connector housing 21 and the faces 32*a*, 32*b*, 32*c* and 32*d* of male connector housing 32, the faces 21*a*, 21*b*, 21*c* and 21*d* lie one upon another with the insides of the faces 32*a*, 32*b*, 32*c* and 32*d*, respectively.

An opening part 36 is provided between the face 32*d* and the male connector body 31 and between the face 32*c* and the male connector body 31. The opening part 36 is a space which can receive a locking arm 48 (explained later on) of the lever 4. The opening part 36 penetrates through the top face 32*f*, from which the locking arm 48 is inserted into the opening part 36.

A ring-shaped sealing member (not shown in the figure) is fit to an end part of an outer periphery of the male connector body 31, said end part being situated near to the top face 32*f*. When the female connector housing 21 is inserted in between the male connector body 31 and the male connector housing 32, the ring-shaped sealing member is located between the female connector housing 21 and the outer periphery of the male connector body 31 so as to seal between female connector housing 21 and the male connector body 31. Thus, the lever fitting-type connector according to the present invention includes the sealing member and the faces 32*a*, 32*b*, 32*c* and 32*d* of male connector housing 32 for covering the 21*a*, 21*b*, 21*c* and 21*d* of the female connector housing 21, respectively. Therefore, the terminals received in the female connector housing 21 and in the male connector body 31 can be protected from water.

As shown in FIG. 2, the lever 4 is made of electrically insulating synthetic resin and includes: a pair of side plates 41*a*, 41*b* arranged in parallel to each other, one end parts of the side plates 41*a*, 41*b* being separated from each other having a distance therebetween; a connecting part 42 for connecting opposite end parts of the side plates 41*a*, 41*b*; a fulcrum projection 44 formed on the respective end parts of the side plates 41*a*, 41*b* and projecting from an inner surface of the side plate 41*a*, 41*b* toward the opposite side plate 41*a*, 41*b*; and a flange part 45 as the coming off-preventing means. The fulcrum projection 44 of the lever 4 is received in one of the fulcrum projection receiving parts 33L and 33R, so that the lever 4 is rotatably supported by the male connector 3 around the one end part of the side plate 41*a*, 41*b*.

The pair of the side plates 41*a*, 41*b* has a plurality of action point projection receiving parts 46, 47, each of which penetrates through the side plate 41*a*, 41*b* and is formed in a long hole-shape. Each action point projection receiving part 46, 47 is formed in an arc-shape. A curvature radius of the action point projection receiving part 46 is smaller than that of the action point projection receiving part 47. A width of the action point projection receiving part 46 in the longitudinal direction thereof is shorter than that of the action point projection receiving part 47 in the longitudinal direction thereof. The action point projection receiving part 46 is situated nearer to the fulcrum projection 44 than the action point projection receiving part 47 is situated. Each center of curvature of the action point projection receiving parts 46, 47 is situated being parted away farther from the female connector 2 than the fulcrum projection 44 is situated.

The action point projections 34 and 35 are received in the action point projection receiving parts 46, 47, respectively. The action point projections 34 and 35 move within the action point projection receiving parts 46, 47, respectively, from one end (near to the female connector 2) to an opposite end (far from the female connector 2) of the action point projection receiving parts 46, 47 in the longitudinal direction of the action point projection receiving parts 46, 47. The opposite ends of the action point projection receiving parts 46, 47 are lined up in the width direction X on a condition that the connector 2 and 3 are fit with each other. This width direction X is parallel to the width direction X of the male connector housing 32 for the lever 4, which is positioned at the fitting position on a condition that the connectors 2 and 3 are fit with each other. That is, a plurality of the action point projection receiving parts 46, 47 are lined up along the width direction X having a distance therebetween. In the preferred embodiment, as shown in FIG. 2, the fulcrum projection 44 formed on the side plate 41*a* is received in the fulcrum projection receiving part 33L formed on the face 32*a*. The action point projection 34 situated at left side in FIG. 2 of the two action point projections 34 and 35 formed on the face 32*a* is received in the action point projection receiving part 46 formed near to the one end of the side plate 41*a*. The action point projection 35 situated at right side in FIG. 2 is received in the action point projection receiving part 47 formed near to the opposite end of the side plate 41*a*.

Since the fulcrum projection engaging parts 23L, 23R, the fulcrum projection receiving parts 33L, 33R, and the action point projections 34, 35 are formed linear-symmetrically along the width direction X with respect to the symmetry axes P1, P2, therefore the lever 4 may be attached in an attaching direction linear-symmetrical with respect to the attaching direction described above. That is, in a case in which the lever 4 is attached in the linear-symmetrical attaching direction, the fulcrum projection 44 of the side plate 41*a* is received in the fulcrum projection receiving part 33R of the face 32*a*, the action point projection 35 of the face 32*a* is received in the action point projection receiving part 46 of the side plate 41*a*, and the action point projection 34 is received in the action point projection receiving part 47 of the side plate 41*a*. That is, in the present invention, the lever 4 can be attached by selecting one appropriate attaching position out of the two attaching positions.

The action point projections 34 and 35 move within the action point projection receiving parts 46, 47, respectively, from the one end to the opposite end of the action point projection receiving parts 46, 47, so that the lever 4 rotates around the fulcrum projection 44-side. In the preferred embodiment, since each center of curvature of the action point projection receiving parts 46, 47 is situated being parted away farther from the female connector 2 than the fulcrum projection 44 is situated, therefore the lever 4 rotates in a direction in which the fulcrum projection 44 is parted from the symmetry axis P2. That is, a movement locus of the fulcrum projection 44 is determined depending on a shape of the action point projection receiving parts 46, 47. Thus, each of the action point projections 34 and 35 and the action point projection receiving parts 46, 47, which moves and guides the fulcrum projection 44, is the moving-guiding means.

In the present invention, since a plurality of the action point projections 34 and 35 and a plurality of the action point projection receiving parts 46, 47, therefore rotation locus of the lever 4 is defined distinctly.

In the present invention, a contact between the action point projection 34, 35 and the action point projection receiving part 46, 47 is an action point of the lever 4. That is, as shown in FIG. 4, when the connector housings 21 and 32 approach each other, a contact S1, S2 between the edge 46*a*, 47*a* situated inside in the radial direction and the action point projection 34, 35 is the action point. When the connector housings 21 and 32 leave each other, a contact between the edge 46*b*, 47*b* situated outside in the radial direction and the action point projection 34, 35 is the action point. In the present invention, since the action point projections 34, 35 and the action point projection receiving parts 46, 47 are arranged along the width direction X having a distance therebetween, therefore the contact, which contact acts as an action point of the lever 4, can be dispersively arranged along the width direction X and therefore, a moment generated due to the rotation of the lever 4 can be equalized along the width direction X of the male connector housing 32.

As shown in FIG. 1, the connecting part 42 includes a connecting plate 43 for connecting the opposite ends of the pair of the side plates 41*a*, 41*b*, a locking arm 48 formed inside the connecting plate 43, and an operation part 49 formed at an end face of the pair of the side plates 41*a*, 41*b*, said end face being parted away from the female connector 2.

An upper end part of the locking arm 48 is connected to both of the side plates 41*a*, 41*b*, said upper end part being parted away from the female connector 2. A lower end part of the locking arm 48 is formed in a quadrilateral frame-shape, said lower end part being near to the female connector 2. The locking arm 48 is positioned outside the connector housing 32 on a condition that the connector housings 21 and 32 are farthest parted from each other, while the locking arm 48 is inserted in the opening 36 and a locking projection 22 formed on the female connector housing 21 engages with a frame-shaped lower end part of the locking arm 48 on a condition that the connectors 2 and 3 fit with each other. Thereby, the locking arm 48, that is, the lever 4 is maintained at a fitting position of the connectors 2 and 3. Therefore, even if unexpected external force is applied on the lever 4, the connector housings 21 and 32 can be prevented from moving in a direction in which the connector housings 21 and 32 are parted from each other.

The operation part 49 is a point on which a load is applied when the lever 4 is rotated in a direction, in which the connector housings 21 and 32 approach each other. Said point is the power point of the lever 4 in the present invention.

The fulcrum projection 44 is positioned movably in the fulcrum projection receiving part 33L, 33R. The fulcrum projection 44 received in the fulcrum projection receiving part 33L, 33R is positioned movably in the fulcrum projection engaging part 23L, 23R. During the rotation action of the lever 4, a contact between an outer peripheral surface of the fulcrum projection 44 and an edge that forms the fulcrum projection engaging part 23L, 23R is the fulcrum point of the lever 4 in the present invention.

The flange part 45 is the coming off-preventing means. The flange part 45 extends in an outer peripheral direction of the fulcrum projection 44 from an outer edge of the fulcrum projection 44, that is, from an end part of the fulcrum projection 44, said end part being parted away from an inner surface of the side plates 41*a*, 41*b*. The flange part 45 is caught by an inner edge of the fulcrum projection engaging part 23L or 23R, so that the side plates 41*a* and 41*b* are prevented from being resiliently deformed in a direction, in which the side plates 41*a* and 41*b* part from each other, even if a moment generated due to the rotation action of the lever 4 is applied on the fulcrum projection 44. Therefore, the fulcrum projection 44 can be prevented from coming off from the fulcrum projection receiving part 33L, 33R.

In the following, shapes of the fulcrum projection engaging part 23L, 23R and the fulcrum projection receiving part 33L, 33R are explained with reference to FIG. 3. Since the fulcrum projection engaging part 23L, 23R and the fulcrum projection receiving part 33L, 33R are formed linear-symmetrically with respect to the symmetry axis P1, P2, therefore, as an example, shapes and a positional relation of the fulcrum projection engaging part 23L and the fulcrum projection receiving part 33L is explained. FIG. 3 shows a view illustrating a positional relation of the fulcrum projection 44, fulcrum projection receiving part 33L and fulcrum projection engaging part 23L on a condition that the connector housings 21 and 32 are farthest away from each other by using a solid lines and a relative positional relation (FIG. 3 showing a positional relation assuming that the male connector housing 32 is immovable) of the fulcrum projection 44 and the fulcrum projection engaging part 23L with respect to the fulcrum projection receiving part 33L on a condition that the connector housings 21 and 32 fit with each other by using alternate long and two short dashes lines.

As shown in FIG. 3, the fulcrum projection receiving part 33L includes a large groove part 60 and small groove part 61. The large groove part 60 is situated nearer to the symmetry axis P2 and nearer to the female connector 2 than the small groove 61 is situated. The large groove part 60 is a space between an edge 33*a*, which is situated near to the symmetry axis P2 and near to the female connector 2 and extends in the width direction X, and an edge 33*c*, which faces the edge 33*a* and is parted farther away from the female connector 2 than the edge 33*a* is. A size L2 of said space along the depth direction Y is larger than a size L1 obtained by summing a size of the fulcrum projection 44 and a size of the flange part 45 in the longitudinal direction. The small groove part 61 is a space between the edge 33*c* and an edge 33*b*, which is situated away from the symmetry axis P2 and faces the edge 33*c*. A size L3 of said space along the depth direction Y is smaller than the size L1. The edges 33*b*, 33*c* are inclined in a direction, in which the edges 33*b*, 33*c* leave the female connector 2, as the edges 33*b*, 33*c* leave the symmetry axis P2.

When the lever 4 is attached to the male connector 3, the fulcrum projection 44 and the flange part 45 are made pass through the large groove part 60 so as to be attached to the male connector 3. At that time, the connector housings 21 and 32 are positioned farthest away from each other. The fulcrum projection 44 is moved from the large groove part 60 toward the small groove part 61 by the moving-guiding means 34, 35, 36, 47 in response to the rotation of the lever 4 as the connector housings 21 and 32 approach each other, while the fulcrum projection 44 is moved from the small groove part 61 toward the large groove part 60 as the connector housings 21 and 32 leave each other.

As shown in FIG. 3, the fulcrum projection engaging part 23L is formed in a long hole-shape along the width direction X. When the fulcrum projection 44, which is received in the fulcrum projection receiving part 33L, is engaged with the fulcrum projection engaging part 23L, the fulcrum projection 44 and the flange part 45 are made pass through an end part of the fulcrum projection engaging part 23L and engaged, said end part being situated near to the symmetry axis P1. At that time, the connector housings 21 and 32 are positioned farthest away from each other. The fulcrum projection 44 is moved from said end part toward an opposite end part of the fulcrum projection engaging part 23L, as the connector housings 21 and 32 approach each other, said opposite end part being situated away from the symmetry axis P1, while the fulcrum projection 44 is moved from the opposite end part toward the end part as the connector housings 21 and 32 leave each other.

As for such a positional relation between the fulcrum projection receiving part 33L and the fulcrum projection engaging part 23L, on a condition that the connector housings 21 and 32 are positioned farthest away from each other, the size L2 of the space between the edge 33*a* and the edge 23*c*, which is arranged at a portion of the fulcrum projection engaging part 23L, said portion being near to the male connector 3, and extends straightly along the width direction, is larger than the size L1. At that time, the edge 23*a* of the fulcrum projection engaging part 23L, which is near to the symmetry axis P1 and situated farther away from the male connector 3 than the edge 23*c* is situated, is arranged at a position where the edge 23*a* lies one upon another with the edge 33*a*. Further, at that time, the edge 33*c* is arranged at a position situated farther away from the female connector 2 than the edge 23*c* is situated. On a condition that connector housings 21 and 32 fit with each other, the edge 23*b* of the fulcrum projection engaging part 23L, which is situated away from the symmetry axis P1 and situated farther away from the male connector 3 than the edge 23*c* is situated, is arranged at a position where the edge 23*b* lies one upon another with the edge 33*b*.

The female connector housing 21 including the fulcrum projection engaging part 23L. and the male connector housing 32 including the fulcrum projection receiving part 33L move while an outer peripheral surface of the fulcrum projection 44 abuts against the edge 23*c* when the fulcrum projection 44 is moved from the large groove part 60 to the small groove part 61 by the moving-guiding means 34, 35, 36, 47. At that time, since the edge 33*b* and the edge 33*c* are inclined in a direction leaving from the female connector 2 as the edge 33*b* and the edge 33*c* leave the symmetry axis P2, therefore the fulcrum projection 44 moves to the small groove part 61 with lifting up the female connector housing 21 toward the male connector housing 32. Thereby, the female connector housing 21 and the male connector housing 32 approach each other.

In the following, a method of assembling the lever fitting-type connector 1 and a sequence of fitting the female connector 2 and the male connector 3 are explained. First, the male connector body 31, in which the terminals with electric wires are inserted in the respective terminal receiving chambers, is attached into the male connector housing 32 from the side of the top face 32*f*. Then, the side plates 41*a*, 41*b* of the lever 4 are made face the surface 32*a*, 32*b* of the male connector housing 32, respectively, one end parts-side of the side plates 41*a*, 41*b* are extended outward each other so as to deform the lever 4 resiliently and then, the fulcrum projection 44 is inserted into the fulcrum projection receiving part 33L of the male connector housing 32 from the large groove part 60. Then, the male connector body 31 and the female connector housing 21, to which the terminals with electric wires are attached, are made face each other. Then, the male connector body 31 is inserted into the female connector housing 21 and the female connector housing 21 is inserted into between the male connector housing 32 and the male connector body 31 so as to provisionally fit them with each other. At that time, the fulcrum projection 44 is press-fit into the fulcrum projection engaging part 23L of the female connector housing 21. Further, at that time, the terminals are not fit with each other and a positional relation between the connector housings 21 and 32 is the positional relation shown by the solid lines in FIG. 3. A condition of the lever fitting-type connector 1 at that time is shown in FIG. 4.

As shown in FIG. 4, the fulcrum projection 44 is positioned in the large groove part 60, while the action point projections 34, 35 are positioned at the one end parts of the action point projection receiving parts 46, 47. When force is applied on the operation part 49 of the lever 4 toward the female connector 2-side from the above condition, the lever 4 is guided by the action point projection receiving parts 46, 47 and starts to rotate around the side, which is situated on the side of the fulcrum projection 44 in the width direction X and situated farther away from the female connector 2 than the fulcrum projection 44 is situated. At that time, the outer peripheral surface of the fulcrum projection 44 and the edge 23*c* of the fulcrum projection engaging part 23L do not come in contact with each other and the moment is not applied on the fulcrum projection 44 and the action point projections 34, 35. That is, the rotation force of the lever 4 is not transmitted to the male connector housing 32 until the outer peripheral surface of the fulcrum projection 44 comes in contact with the edge 23*c* of the fulcrum projection engaging part 23L. However, as described above, since the edge 33*b* and the edge 33*c* are inclined in a direction leaving from the female connector 2 as the edge 33*b* and the edge 33*c* leave the symmetry axis P2, therefore the fulcrum projection 44 gradually moves in a direction in which the fulcrum projection 44 approaches the edge 23*c* of the fulcrum projection engaging part 23L.

Then, as shown in FIG. 5, on a condition that the fulcrum projection 44 is moved to a position where the outer peripheral surface thereof comes in contact with the edge 23*c* of the fulcrum projection engaging part 23L, the rotation force of the lever 4 is transmitted to the male connector housing 32 through the contacts S1, S2 between the action point projections 34, 35 and the action point projection receiving parts 46, 47 and the male connector body 31 is inserted into the female connector housing 21. At that time, the fulcrum projection 44 is positioned in the small groove part 61. When the lever 4 is rotated further, the lower end part of the locking arm 48 engages with the locking projection 22 formed on the face 21*d* of the female connector housing 21, the male connector body 31 is completely inserted in and fit with the female connector housing 21, and the terminals of both sides are fit with each other, so that the fitting between the male connector 3 and the female connector 2 is completed. The condition at that time is shown in FIG. 6. As shown in FIG. 6, the fulcrum projection 44 is positioned in the small groove part 61 and the action point projections 34, 35 are positioned at the opposite end parts of the action point projection receiving parts 46, 47.

When the fitting between the male connector 3 and the female connector 2 is removed, the locking arm 48 is bent so as to remove the rock between the locking projection 22 and the locking arm 48. On a condition that the rock between the locking projection 22 and the locking arm 48 is removed, the lever 4 is rotated in a releasing direction which is opposite to the fitting direction of the connector housings 21 and 34. When the lever 4 is rotated in the releasing direction, the lever 4 rotates in a direction opposite to the direction in which the connector housings 21 and 34 approach each other with respect to a fulcrum which is a contact between the outer peripheral surface of the fulcrum projection 44 and the edge 23*b* of the fulcrum projection engaging part 23L. This rotation force is applied on the male connector housing 32 through the contact between the action point projections 34, 35 and the edge 46*b*, 47*b* of the action point projection receiving parts 46, 47, so that the male connector body 31 is released from the female connector housing 21.

As described above, in the preferred embodiment, since the end parts of the pair of the side plates 41*a*, 41*b* are separated from each other having a distance therebetween, therefore the lever 4 can be attached to the male connector 3 after the terminals with electric wires are inserted in the male connector 3. Therefore, the workability of assembling the connectors 2, 3 can be improved. Since only the lever 4 can be replaced in the event that the lever 4 is broken during use, therefore a man-hour and cost required to replace the lever 4 upon breakage can be reduced. Further, the lever 4 has the flange part 45 as the coming off-preventing means for preventing the fulcrum projection 44 from coming off from the fulcrum projection receiving part 33L, 33R, therefore the lever 4 can be prevented from coming off from the connector 2, 3 while the lever 4 is rotated. Since the fulcrum projection receiving part 33L, 33R includes the large groove part 60 formed larger in size than a summed size of the fulcrum projection 44, the flange part 45 and the small groove part 61 formed smaller in size than a summed size of the fulcrum projection 44 and the flange part 45, and the moving-guiding means for moving the fulcrum projection 44 between the large groove part 60 and the small groove part 61, that is, the action point projection 34, 35 and the action point projection receiving part 46, 47, therefore the lever 4 can be easily attached to the connector 2, 3. Therefore, the workability of assembling the lever fitting-type connector 1 can be improved.

Further, in the preferred embodiment, since a plurality of the action point projections 34, 35 and a plurality of the action point projection receiving parts 46, 47 are provided, therefore a rotation locus of the lever 4 can be defined distinctly. Therefore, the operation feeling of the lever 4 can be prevented from being uneven and the operation feeling can be easily adjusted. Therefore, a lever fitting-type connector 1 having excellent workability and operation characteristic can be provided. Further, since the action point projections 34, 35 and the action point projection receiving parts 46, 47 are arranged along the width direction X of the connector housing 21, 32 having a distance therebetween, therefore the action point of the lever 4 can be dispersively arranged along the width direction X and therefore, a moment generated due to the rotation of the lever 4 can be equalized along the width direction X of the male connector 3. Accordingly, even if the male connector 3 is made long in size in the width direction X thereof, the male connector 3 and the female connector 2 can be securely fit with each other.

Further, in the preferred embodiment, since the fulcrum projection engaging parts 23L, 23R, the fulcrum projection receiving parts 33L, 33R and the action point projections 34, 35, are provided linear-symmetrically with respect to the respective symmetry axis P1, P2, therefore the lever 4 can be attached by selecting a preferable one attaching position of the attaching positions of the two directions. That is, a degree of freedom for arranging the lever 4 can be improved.

Further, in the preferred embodiment, since the female connector 2 is provided with the locking projection 22 engaging with the lever 4 that is positioned at a fitting position where the connectors 2 and 3 are fit with each other, therefore the lever 4 can be maintained to be the fitting position. Therefore, even if unexpected external force is applied on the lever 4 after the engagement of the locking projection 22, the connectors 2 and 3 can be prevented from moving in a direction in which the connectors 2 and 3 are parted from each other.

In the preferred embodiment described above, the coming off-preventing means is the flange part 45. However, instead, the coming off-preventing means may be a split pin formed separately from the fulcrum projection 44. In the preferred embodiment described above, the action point projections 34, 35 are provided to the male connector housing 32 and the action point projection receiving parts 46, 47 are provided to the side plates 41*a*, 41*b* of the lever 4. However, instead, the action point projections 34, 35 may be provided to the side plates 41*a*, 41*b* of the lever 4 and the action point projection receiving parts 46, 47 may be provided to the male connector housing 32. Further, the action point projection 34, 35 may have a shape different from a cylindrical shape, for example, a polygon-shape. The action point projection receiving part 46, 47 may not necessarily be a hole penetrating through the side plate 41*a*, 41*b* or the male connector housing 32 and instead, may be a hollow or rail which can receive the action point projection 34, 35.

In the preferred embodiment described above, the first connector is the female connector 2, while the second connector is the male connector 3. However, instead, the first connector may be a male connector including female terminals, while the second connector may be a female connector including male terminals. That is, the lever may be rotatably provided to a connector housing of a female connector. Further, in the preferred embodiment, the locking projection 22 as the engaging means is provided to the female connector 2. However, instead, the engaging means may be provided to the male connector 3 or, alternatively, to both of the female connector 2 and the male connector 3. Further, the engaging means may have any shape provided that the engaging means can fix the lever 4. Further, in the preferred embodiment, the lever fitting-type connector 1 is a waterproof connector having a sealing member. However, instead, the lever fitting-type connector 1 may not necessarily have a sealing member.

The aforementioned preferred embodiments are described to aid in understanding the present invention and variations may be made by one skilled in the art without departing from the spirit and scope of the present invention.

What is claimed is:

1. A lever fitting-type connector comprising:

a first connector;

a second connector to be fit with the first connector;

a lever provided rotatably to a connector housing of the second connector, the lever including a pair of side plates arranged in parallel to each other, one end parts of the side plates being separated from each other having a distance therebetween, a connecting part for connecting opposite end parts of the side plates, and a fulcrum projection formed on the one end part of at least one of the side plates and projecting from an inner surface of the side plate toward the opposite side plate;

a fulcrum projection receiving part formed on a surface of the connector housing of the second connector, said surface lying one upon another with the side plate, the fulcrum projection receiving part receiving the fulcrum projection;

a fulcrum projection engaging part formed on a surface of a connector housing of the first connector, said surface lying one upon another with the side plate, the fulcrum projection engaging part engaging with the fulcrum projection received in the fulcrum projection receiving part; and a coming off-preventing means for preventing the fulcrum projection from coming off from the fulcrum projection receiving part, wherein the lever is rotated so that the connector housing of the first connector and the connector housing of the second connector approach or leave each other.

2. The lever fitting-type connector according to claim 1, wherein a pair of the fulcrum projection engaging parts and a pair of the fulcrum projection receiving parts are provided at respective positions linear-symmetrical with respect to an symmetry axis, which is parallel to the approaching-and-leaving direction of the connector housing of the first connector and the connector housing of the second connector, said symmetry axis passing through a center of each surface of the connector housing of the first or the second connector, said surface lying one upon another with the corresponding side plate of the lever.

3. The lever fitting-type connector according to claim 1, wherein the moving-guiding means includes:

a plurality of action point projections each formed on one of a surface of the connector housing of the second connector and the side plate of the lever, said surface lying one upon another with the side plate of the lever, the action point projection projecting from said one toward another; and a plurality of action point projection receiving parts having a long hole-shape for receiving the action point projections, the action point projection receiving part being formed on said another, wherein a plurality of the action point projections and a plurality of the action point projection receiving parts are arranged along a width direction of the connector housing or along a width direction of the side plate having a corresponding distance therebetween.

4. The lever fitting-type connector according to claim 1, wherein a pair of the action point projections or a pair of the action point projection receiving parts is provided at respective positions linear-symmetrical with respect to an symmetry axis, which is parallel to the approaching-and-leaving direction of the connector housing of the first connector and the connector housing of the second connector, said symmetry axis passing through a center of a surface of the connector housing of the second connector, said surface lying one upon another with the side plate of the lever.

5. The lever fitting-type connector according to claim 1, wherein at least one of the first and second connector is provided with an engaging means engaging with the lever that is positioned at a fitting position where the first and second connectors are fit with each other.

6. The lever fitting-type connector according to claim 1, wherein the coming off-preventing means is a flange part extending in an outer peripheral direction of the fulcrum projection from an outer edge of the fulcrum projection.

7. The lever fitting-type connector according to claim 6, wherein the fulcrum projection receiving part includes: a large groove part formed larger in size than a summed size of the fulcrum projection and the flange part; and a small groove part formed smaller in size than a summed size of the fulcrum projection and the flange part, wherein the fulcrum projection is positioned in the large groove part on a condition that the connector housing of the first connector and the connector housing of the second connector are parted farthest from each other, wherein the lever fitting-type connector further comprises a moving-guiding means for moving the fulcrum projection from the large groove part toward the small groove part in response to rotation of the lever as the connector housing of the first connector and the connector housing of the second connector approach each other.

* * * * *